F
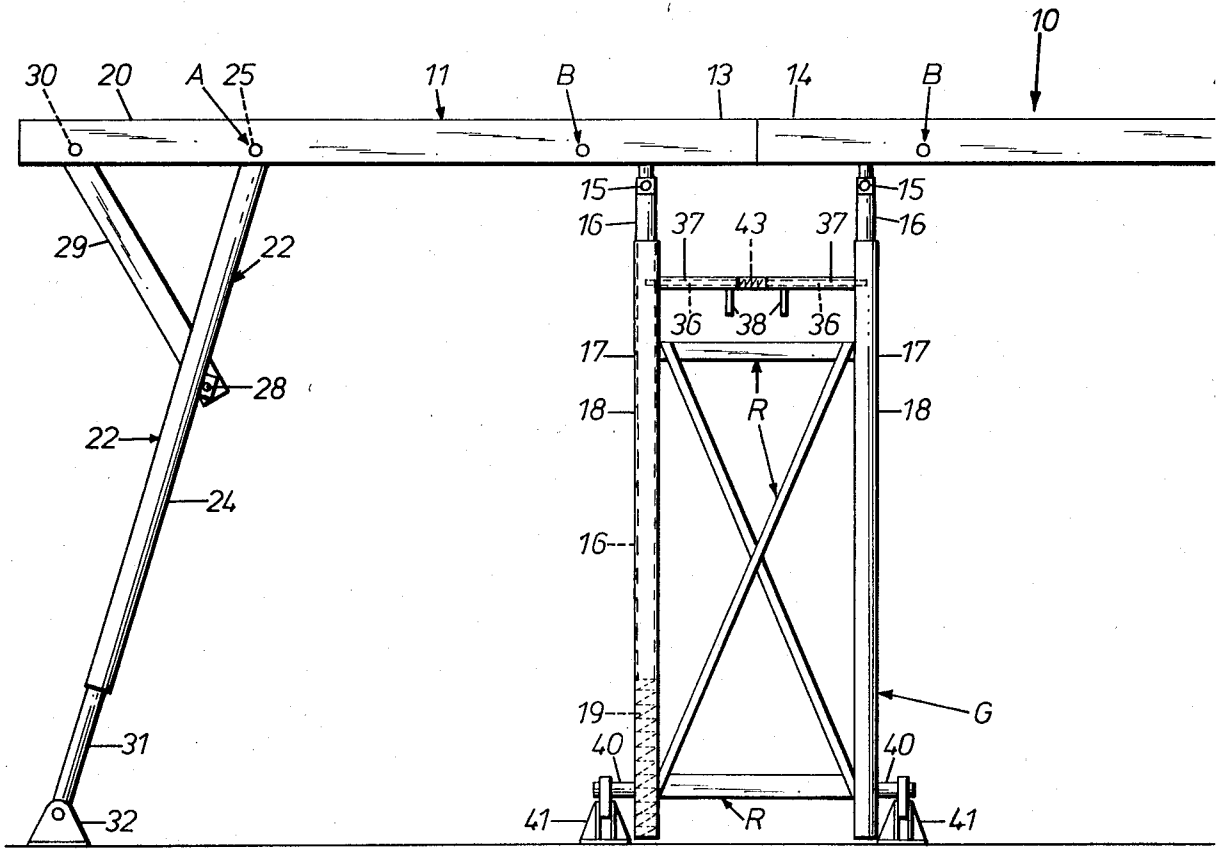

ADJUSTABLE PLATFORM SCAFFOLDING

FIELD OF THE INVENTION

My present invention relates to adjustable platform scaffolding and, more particularly, to an adjustable scaffolding having two adjustable-height scaffolding platforms, the scaffolding having an erect working position in which the platforms are horizontal and a rest position for convenience of storage and transport in which the platforms are disposed on edge, the platforms being swingable.

BACKGROUND OF THE INVENTION

Scaffoldings of the general type above described comprise a plurality of telescoping variable-height adjustable supports each having an outer pipe and an inner pipe slidably mounted inside of the outer pipe and two scaffolding platforms attached to the telescoping supports so as to be pivotable about horizontal pivot axes, each of the scaffolding platforms having an upright or "on-edge" resting or storage position and a horizontal working position, the platforms being swingable between these positions.

A scaffolding of this kind is described in particular in the prospectus "The SICO Performer" of SICO INCORPORATED, Minneapolis, Minn., U.S.A. in which prior uses are disclosed. Both telescoping outer supports of each scaffold platform are attached to both of the outer supports of the other scaffolding platform by slanting pivotally attached telescoping supports equally movable with respect to each other using scissor-type linkages.

OBJECTS OF THE INVENTION

It is the general object of my invention to provide an improved adjustable platform scaffolding which is more universally applicable and moreover particularly easily adjustable.

It is a further object of this invention to provide an adjustable-height scaffolding which is more flexible as to its uses and applications having individually adjustable platforms whose height may be separately controlled and adjustable supports so that it is more easily used in a greater variety of situations.

SUMMARY OF THE INVENTION

These objects and others which will become apparent hereinafter are attained in accordance with the invention in an adjustable-height scaffolding comprising a plurality of telescoping variable height-adjustable supports each having an outer pipe and an inner pipe slidably mounted inside the outer pipe and two scaffolding platforms attached to the telescoping supports so as to be pivotable about a horizontal pivot axis, each of the scaffolding platforms having an upright resting position and a collapsible horizontal working position.

According to the invention four such telescoping support legs or struts are provided as central supports for the scaffolding, the central supports forming corner posts for a substantially rectangular statically rigid frame centrally supporting the scaffolding platforms, and two of the telescoping supports are pivotally attached to each of the scaffolding platforms adjacent the other one of the scaffolding platforms, the top portions of the inner pipes of the corner posts being attached pivotally to the respective scaffolding platform.

Correspondingly the invention is therefore first provided with a rigid framework of a basically rectangular shape, which comprises four telescoping supports arranged in a quadrilateral, the corner posts providing the principal supporting arrangement for the scaffolding both in the resting and the working positions. Since the corner posts and the outer adjustable supports of one scaffolding platform can be adjusted independently of the corresponding corner posts and outer adjustable supports of the other scaffolding platform, the scaffolding of the invention allows—as opposed to that of the prior art—a stepped configuration with one platform higher or lower than the other, whereby the scaffolding according to the invention has more universal applicability.

While in the known scaffolding the height of both scaffolding platforms must be adjusted so as to be equal, my invention permits a separate—and hence easier—height adjustment of each scaffolding platform.

In particular the height adjustment in the scaffolding is accomplished as follows: Both pairs of corner posts belonging to each of the scaffolding platforms are extended to the desired height, stopped and held in place by locking pins or locking rods. Then both scaffolding platforms are swung successively into position. The outer supports swing out of their inwardly swung or folded resting positions and are extended to their required length and are stopped and locked in position, thereby fixing the working position of the scaffolding.

The telescoping supports of the inventive platform, namely the corner posts as well as the outer supports, can be provided with a roller foot as an aid for moving the scaffolding, this foot or roller or caster being swingable out of the way as in the operative or working position. In this way the scaffold can be independently transported both in its resting or collapsed position and in its working position.

According to a further feature of the invention the inner pipes of the telescoping corner posts are attached at their top portions pivotally to the underside of their associated scaffolding platforms and are supported from below by a compressible insert in the outer pipe. Advantageously this compressible insert may be a coil spring but the compressible means can also be a compressible fluid such as compressed air or another type of spring.

According to a preferred embodiment of the invention each of the outer supports is constructed as a slanted or slantable support inclined to the outside of the scaffolding, each of the outer supports being foldable against the underside of the associated scaffolding platform and pivotable about an outer support pivot on the underside of the associated scaffolding platform.

Furthermore each of the slanted outer supports is provided with means enabling it to be locked selectively in two attachment positions on each of the scaffolding platforms, the attachment positions corresponding to a resting position and a working position. Each of these outer supports is additionally connected to the associated scaffolding platform by a guide rod. In their working position, each of the slanted outer supports is locked into the scaffolding platform between both the places of attachment of the guide rods and the associated corner posts. These guide rods are pivotally attached to the associated scaffolding platform with clearance from the upper ends of the slanted supports.

In yet another feature of the invention each pair of the outer supports associated with each one of the scaffolding platforms are attached to each other by a rigid frame. The rigid frame can be attached either to the inner pipe or to the outer pipe of the telescoping outer supports.

BRIEF DESCRIPTION OF THE DRAWING

The above and other objects, features and advantages of the invention will become more readily apparent from the following description, reference being made to the accompanying drawing in which:

FIG. 1 is a highly schematic side view of a preferred embodiment of the scaffolding in its operating position, and with the adjustable horizontally extended scaffold platforms in equal-height side-by-side relationship;

SPECIFIC DESCRIPTION

Figure 2:
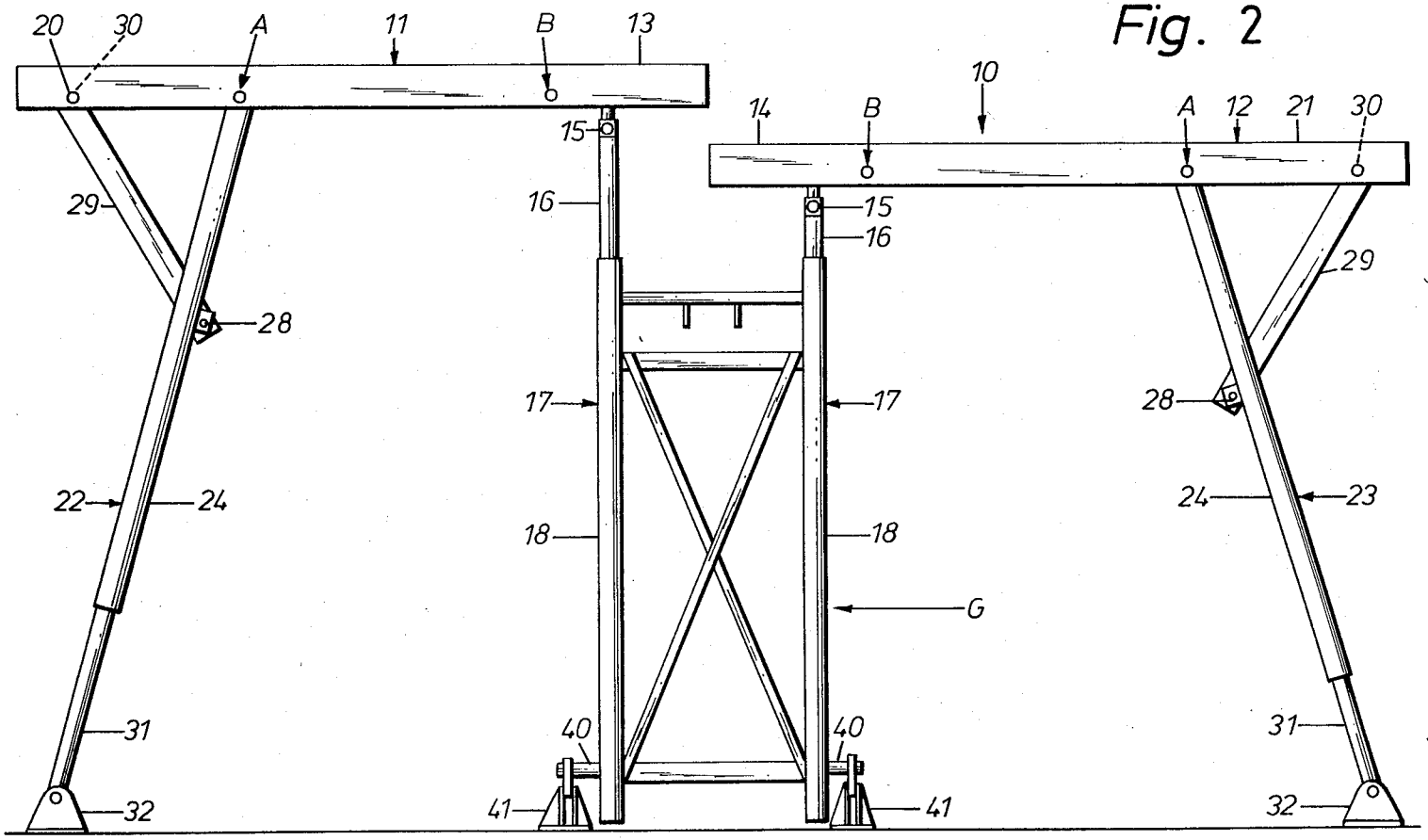
FIG. 2 is a schematic side view of the apparatus of FIG. 1 but with the scaffold platforms stepped with respect to one another.
Figure 2:
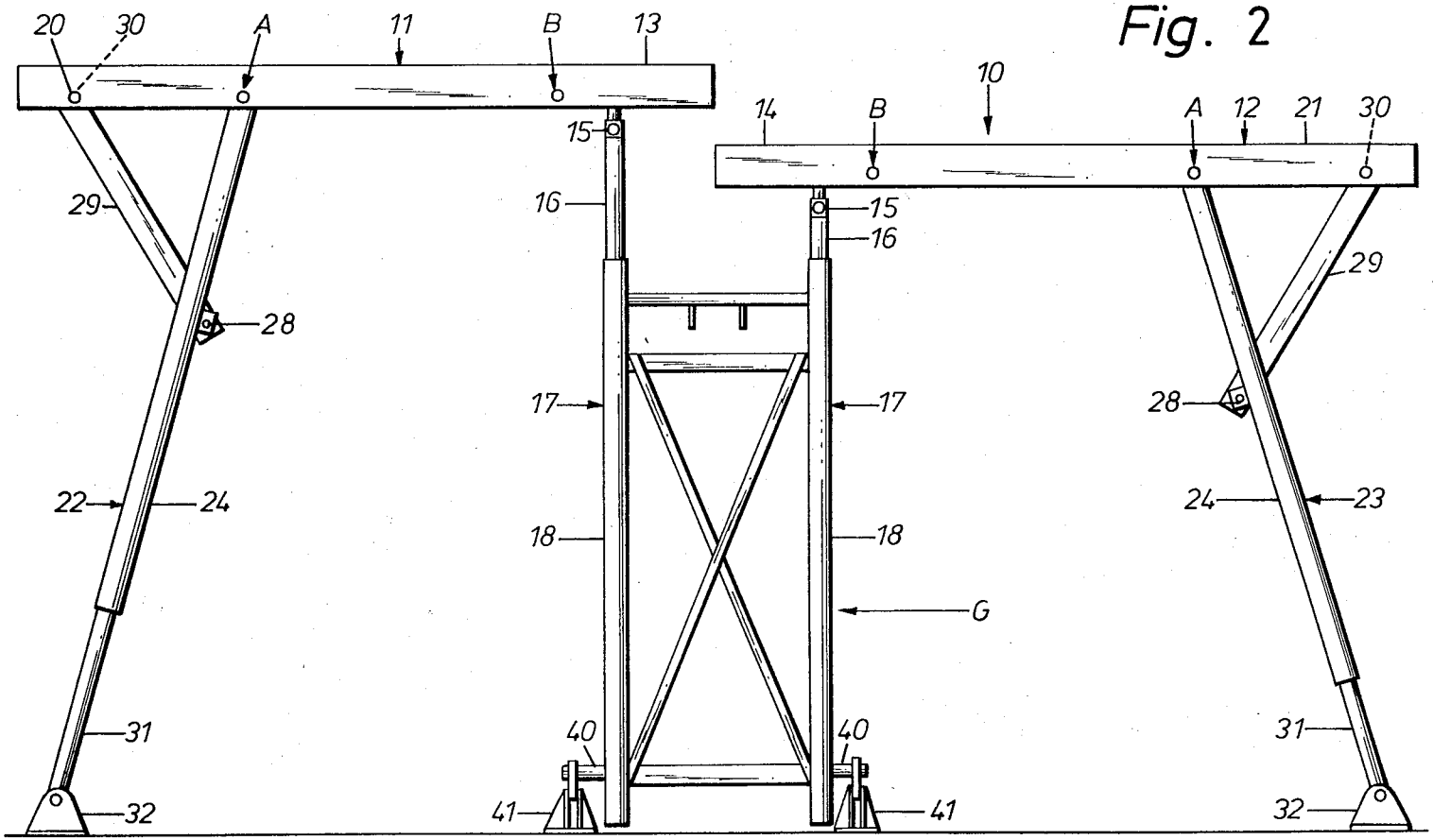

The scaffolding 10 has two scaffolding platforms 11 and 12, which with their inside edge regions 13 and 14 adjacent each other are each pivotable about their parallel pivot axes 15 on the upper portions or tops of the inside tubes 16 slidably mounted in the telescoping corner posts 17.

The inner tubes 16 of the corner posts 17 are guided slidably in outer tubes 18. On its underside each inner tube 16 is supported by a compressible insert, preferably a coil spring 19, which is so proportioned and has such spring characteristics that essentially an approximately balanced condition is reached continually as the dead weight operating on the upper side of the inner tube 16 causes a downward compression of the spring. The outer tube 18 can be formed as a cylinder in which the coil spring 19 is employed and the inner tube 16 can be similarly formed as a piston operating in the outer tube 18 or as a regulatable or controllable compressible insert (compressible gas or compressible fluid).

Each scaffolding platform 11 and 12 has in the vicinity of its outer edges 20 and 21 two telescoping outer supports 22 and 23. The outer supports 22 and 23 with their upper outer tubes 24 are pivotable each by means of a detachable attachment bar 25 each belonging to an underside of one of the scaffolding platforms 11 or 12, the attachment bars 25 being axially guided in a guide tube 26. The attachment bars 25 provide an outer support pivot for the outer supports 22 and 23.

Figure 3:
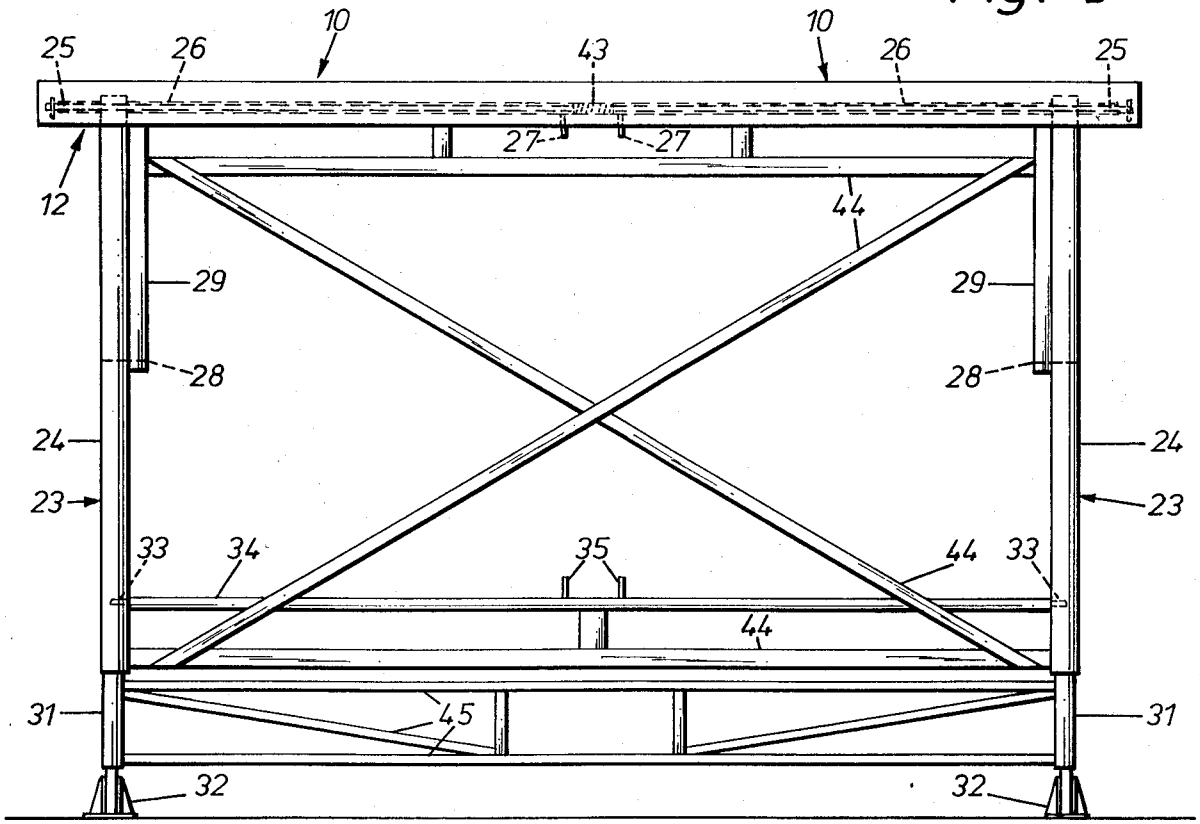
FIG. 3 is a schematic view of the novel apparatus of FIG. 1 as seen in the direction of the arrow III, however with omission of the rigid corner post framework centrally supporting the scaffolding.

In FIGS. 1, 2 and 3, the attachment rods 25 are each engaged in an attachment position A in the scaffold platforms 11 and 12. In the collapsed resting position of the scaffolding 10 each of the attachment rods 25 is dropped into the position B in the scaffolding platform 11 or 12. At times two independently movable attachment bars 25 positioned in a common guide tube 26 can be drawn to each other by two operating handles 27 against the opposing force of a compressible spring 43 centrally positioned between both attachment bars 25.

A guide rod 29 is provided attached pivotally with clearance from the upper end of the outer supports 22 and 23 by joint 28. Each guide rod 29 further is pivotally attached to each scaffolding platform 11 and 12 at the pivot position 30 near the outer edges of the platform 11 and 12.

Each inner tube 31 of the telescoping supports 22 and 23 has on its underside a pivotable foot 32. For use of the pivotable foot 32 a guide roller (not shown) or some alternative structure combined with pivotable foot 32 can be provided.

Similarly the attachment arrangement, i.e. attachment rods 25, guide tubes 26 and handles 27, provide ways both for adjustably raising the corner posts 17 and also the outer supports 22 and 23.

Thus the attachment rods 33 in guide tube 34 with operating handles 35 engage the outer supports 22 and 23. Likewise the attachment rods 36 lengthwise shiftable in guide tubes 37 with operating handles 38 are attached between corner posts 17. Also here as well opposing springs are provided centrally between the attachment rods 36.

The four corner posts 17 are attached to each other by the frame parts indicated partially by R to form a rigid frame G. That rigid frame G forms the actual supporting structure of the scaffolding 10.

The operation of this novel scaffolding 10 is clearly as follows: In the resting position the scaffolding 10, as is shown for example in FIG. 4, can be transported with the inner tubes 16 riding entirely or partially on the guide rollers 39. The pivotable feet 41 inserted on and pivotable about the axis 40 are provided alternatively to the guide rollers 39, which according to operation of the manipulating lever 42 shown in FIG. 5 will reach an erected position accordingly in FIGS. 1 and 2.

Figure 4:
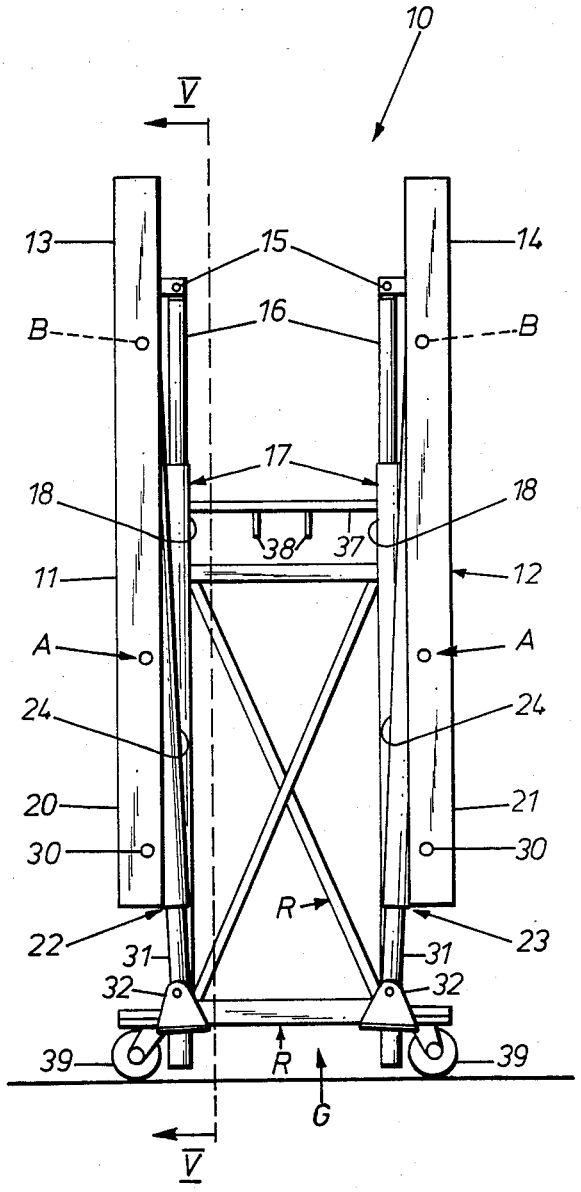
FIG. 4 is a side view of the scaffolding of FIG. 1 in a rest or folded position or found in a collapsed together position, however with inner tubes more highly extended by comparison to FIG. 1.
Figure 5:
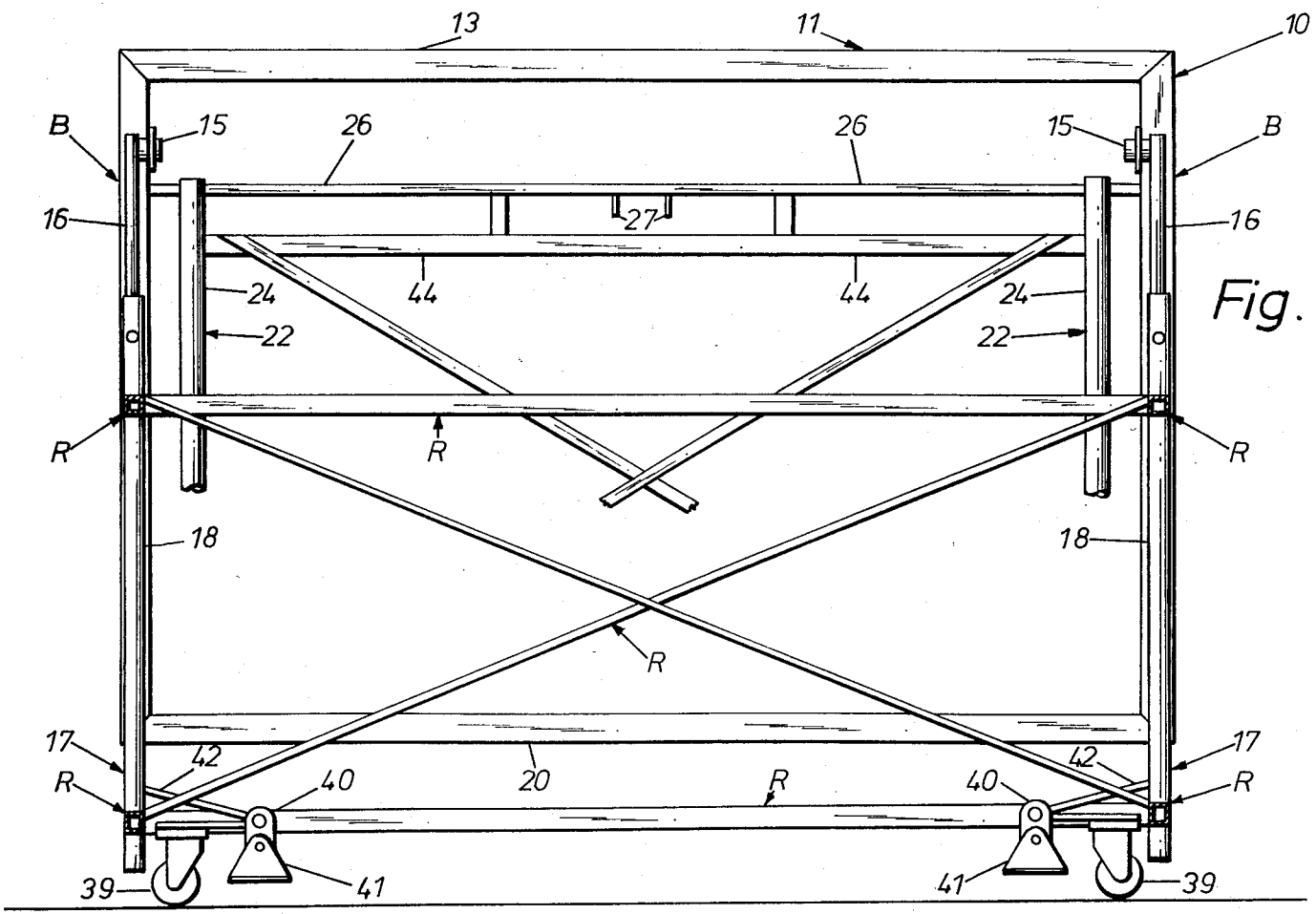
FIG. 5 is a simplified sectional view corresponding to section line V—V of FIG. 4 of the apparatus of FIG. 1, however with the outer supports shown cutaway.

This erected position may be achieved, while the scaffolding 10 is still in the resting position according to FIG. 4.

The inner tubes 16 can be raised and stopped at a definite height through use of the operating handles 38 which are basically independent of each other. The attachment rods 36 engage in lock holes in the walls of the inner tubes 16 to stop and hold the inner tubes 16 in place. The height adjustment of the inner tube 16 can be made so that either a condition of equal heights according to FIG. 1 or a stepped configuration according to FIG. 2 will be attained.

After the height adjustment of inner tubes 16 (from the resting condition according to FIG. 4) the scaffolding platforms 11 and 12 can be successively set out into their horizontal position. The attachment rods 25 are removed from their resting position B and are locked into the operating position A with the guide rods 29 directed toward the outside after pivoting of the slanted outer supports 22 and 23 into position, for example, first the outer support 22. So then inner tubes 31 are extended the desired amount and, by the attachment structures 33, 34 and 35, engaged in position. The inner tube 31 has lock holes (not shown) which cooperate with the attachment rods 33.

Additionally, mention should be made that both the outer supports 22 and 23 of each scaffolding platform 11 and 12 are connected to each other by a frame 44 and 45 at times on the outside tube 24 and/or the inside tube 31.

I claim:

1. In an adjustable scaffolding comprising a plurality of telescoping variable-height adjustable supports each having an outer pipe and an inner pipe slidably mounted inside said outer pipe and two scaffolding platforms pivotally attached to said telescoping supports with a horizontal pivot axis, each of said scaffolding platforms being swingable between an upright rest position and a horizontal working position, the improvement wherein four of said telescoping supports are provided as central supports for said scaffolding, said central supports forming corner posts for a central substantially rectangular frame supporting said scaffolding platforms, and two of said telescoping central supports are pivotally attached to each of said scaffolding platforms adjacent the other one of said scaffolding platforms, the top portions of said inner pipes of said corner posts being attached pivotally to said scaffolding platforms so that the height of each of said platforms can be independently adjusted.

2. The improvement defined in claim 1 wherein said corner posts associated with said scaffolding platforms may be jointly raised and lowered together, said corner posts associated with one of said scaffolding platforms being raisable and lowerable independently of said corner posts of said other one of said scaffolding platforms.

3. The improvement defined in claim 1 wherein each of said inner pipes of said corner posts is supported from below by a compressible insert providing a force directed to respond to up and down motions of each of said inner pipes.

4. The improvement defined in claim 3 wherein said compressible insert is a coil spring substantially balancing the entire weight of said inner tubes and the associated scaffolding platforms and outer supports, said coil spring supporting the underside of said inner pipes.

5. The improvement defined in claim 1, further comprising telescoping outer supports pivotally connected to each platform and each constructed as a slanted support inclined to the outside of said scaffolding, each of said outer supports being foldable to the underside of said associated scaffolding platforms and pivotable about an outer support pivot on an underside of a respective scaffolding platform.

6. The improvement defined in claim 5 wherein each of said slanted outer supports is lockable selectively in two attachment positions on each of said scaffolding platforms, said attachment positions comprising a resting position and a working position and each of said outer supports is additionally connected to the respective platform by a guide rod.

7. The improvement defined in claim 6 wherein in said working position each of said slanted outer supports is locked into a respective scaffolding platform between the places of attachment of a respective guide rod and corner post, said guide rods being pivotally attached to the respective platform with clearance from upper ends of said slanted supports.

8. The improvement defined in claim 1 wherein each pair of said outer supports associated with each scaffolding platform are interconnected by a rigid frame.

9. The improvement defined in claim 8 wherein inner tubes of each pair of said outer supports are attached to each other.

10. The improvement defined in claim 8 wherein outer tubes of each pair of said outer supports are attached to each other.

* * * * *